US006200046B1

(12) United States Patent
Rylander

(10) Patent No.: US 6,200,046 B1
(45) Date of Patent: Mar. 13, 2001

(54) CHEWABLE DEVICE

(76) Inventor: Kurt Marcus Rylander, P.O. Box 5, Ridgefield, WA (US) 98642

( * ) Notice: Subject to any disclaimer, the term of this patent is extended or adjusted under 35 U.S.C. 154(b) by 0 days.

(21) Appl. No.: 09/375,798

(22) Filed: Aug. 17, 1999

Related U.S. Application Data

(60) Provisional application No. 60/097,260, filed on Aug. 20, 1998.

(51) Int. Cl.[7] ..... B43K 25/00

(52) U.S. Cl. ..... 401/52; 401/195; 401/243

(58) Field of Search ..... 401/195, 52, 49, 401/243, 202, 98, 88, 61

(56) References Cited

U.S. PATENT DOCUMENTS

| | | | |
|---|---|---|---|
| D. 307,920 | 5/1990 | Sekiguchi . | |
| D. 353,157 | 12/1994 | Kaplan . | |
| 3,615,596 | 10/1971 | Petti | 401/52 |
| 5,174,672 | 12/1992 | Townsend . | |
| 5,826,997 | 10/1998 | Coleman et al. | 401/52 |
| 5,951,184 | 9/1999 | Sanchez | 401/52 |

OTHER PUBLICATIONS

Picture of Pencil with two rubber collars and TM Name "Mighty Mouse", No Date.

*Primary Examiner*—David J. Walczak
(74) *Attorney, Agent, or Firm*—Kurt M. Rylander

(57) ABSTRACT

A chewable writing instrument. A chewable sheath attachable to a writing instrument. A chewable sheath containing writing means having a writing end and a non-writing, chewable end. The chewable sheath or combination is suitable for placement into the human oral cavity and adapted for the chewing action of the teeth, lips, gum, and tongue. A chewable sheath protects the mouth, teach, tongue, and tissue of the chewer. A chewable sheath protects the chewer. A chewable sheath protects the chewer's clothing. A chewable sheath or combination with dental hygiene conformations provides a supplement to daily dental hygiene care. A chewable sheath or combination flavored with flavoring aromatic and tasteful to the chewer enhances chewing pleasure. A chewable sheath or combination flavored with flavoring bitter and unattractively flavored to the chewer aids in breaking bad chewing habits. A chewable sheath or combination flavored with flavoring nicotine or nicotine tasting substances provides oral satisfaction and aids in breaking the smoking and tobacco chewing habits.

8 Claims, 2 Drawing Sheets

CHEWABLE DEVICE

The present application claims the benefit of prior U.S. Provisional patent application Ser. No. 60/097,260 filed on Aug. 20, 1998.

CHEWABLE DEVICE

1. Field of the Invention

The invention relates to dental and dental hygiene products, tension relievers, writing instruments, and writing instrument attachments such as caps, sleeves, sheaths, grippers, holders, and erasers.

2. Background of the Invention

Writing instruments are used universally and can take the form of ink pens, ball point pens, felt-tip pens, pencils, mechanical pencils, highlighters, and markers, to name a few. Many people suffer from the habit of chewing on the end of a writing instrument or chewing on a writing instrument attachment such as a cap, sheath, eraser, grip, or other accessory. Chewing on a writing instrument or writing instrument attachment can cause damage to the writing instrument, rendering it nonfunctional or causing the leakage of ink or chemicals onto clothes, skin, personal articles, or in the oral cavity; and can cause damage such as chipping, abrasion, and scratching to the teeth, gums, and oral cavity of chewers. Continued chewing on a standard pen cap breaks the pen cap, allowing moisture to enter the interior of the cap, eventually ruining the cap and the pen, and introduces broken sharp edges into the oral cavity and allows ingestion of plastic or other toxic material. Chewing on a lead or graphite based pencil or on ink or chemical containing pens can lead to toxic poisoning of the chewer. Chewing on the end of a writing instrument or writing instrument attachment also frays and damages the ends of writing instruments or writing instrument attachments so as to render it unattractive to the chewer and others. People also suffer from bad dental hygiene.

Existing erasers, grips, sleeves, caps, and other accessories or attachments placeable on the end of a writing instrument are themselves destroyed and damaged by the chewing action, rendering their utility void and the protection of the teeth, gums, oral cavity, clothing, skin, and personal articles nonexistent. Existing articles also fray and damage in a manner unattractive to the chewer and others.

Existing writing instruments are made of materials which are damaged by chewing and immersion in moist environments, such as in an oral cavity. Chewing on and dampening existing writing instruments destroys or hampers the functioning of the writing instruments. Further, the material of which existing writing instruments are made provides little or no protection to the teeth, gums, oral cavity, clothing, skin, and personal articles of individuals who chew on writing instruments.

Edible writing accessories have been made to encourage children to use writing instruments, such as U.S. Pat. No. 3,615,596, a writing accessory, U.S. Pat. No. 5,826,997, a pop-eye pen and candy holder, and U.S. Design Pat. No. 353,157, a combined writing instrument and confection. However, edible writing accessories are not durable, being quickly consumed. They further do not provide any dental hygiene benefit. Moreover, edible writing accessories are not designed for, and do not provide, protection to teeth, gums, and the oral cavity. Edible instruments are not designed for and do not provide protection to the writing instrument itself, clothing, or external skin from the chewing action by human teeth. Like erasers, sheaths, sleeves, grips, caps, and other writing instrument attachments or accessories, edible ends are quickly chewed through, compromised, or consumed rendering the protective and hygienic utility void. Moreover, U.S. Design Pat. No. 353,157 discloses a metallic ridge in or next to the chewing region which would be destructive to lips, tongue, and teeth if chewed upon or inserted into an oral cavity.

Protective caps for pens exist, such as U.S. Design Pat. No. 307,920, a protective end cap for a ball point pen, and U.S. Pat. No. 5,174,672, a short pen having a relatively long cap. These disclosures but make no reference to chewing activity, or insertion into an oral cavity, or indicate any protection of teeth, gums, tongue, lips, clothing, or protection from ingestion of toxic materials, or suggest any combination with chewable articles to effect such protection.

Numerous chewable articles exist, such as U.S. Reissue Pat. No. 34,352, a therapeutic pet toy, U.S. Pat. No. 4,513,014, a chewable toy for an animal, U.S. Pat. No. 4,519,386, a mouth splint, U.S. Pat. No. 4,585,416, a device for cleaning teeth and massaging gums, U.S. Pat. No. 4,765,324, a sports mouthguard with shim, U.S. Pat. No. 5,653,731, a pacifier having a shield with chewing beads, U.S. Pat. No. 5,766,223, a childs teething device, U.S. Pat. No. 3,924,638, a tension reliever, U.S. Pat. No. 4,149,815, a chewable tooth cleaning device, U.S. Pat. No. 4,425,911, a bite block, U.S. Pat. No. 4,432,114, a dental care device and brush body suitable therefor. These disclosures make no reference to writing instruments or chewable articles in connection with writing instruments, and makes no suggestion of combining writing instruments with chewable articles.

SUMMARY OF THE INVENTION

A chewable sheath attachable to a writing instrument or integral with a writing instrument or writing means provides an object of oral focus for people who chew on the ends of writing instruments. A chewable sheath designed to provide dental hygiene in use acts as a supplement to daily dental hygiene care, improving the circumstances of peoples lives. A chewable sheath provides protection from puncturing the writing instrument or causing a leak of the writing instrument serving to protect individuals from damage to clothes, skin, personal articles or the oral cavity, and to protect individuals from toxic poisoning. A chewable sheath provides protection from chipping, abrasion, scratching, scarring, contusion, and puncture to the teeth, gums, tongue, and oral cavity of the chewer. A chewable sheath provides protection from unattractive fraying and damage to the ends of a writing instrument or a writing instrument attachment.

Heretofore, a chewable sheath with the foregoing properties have not been available.

The present invention overcomes the above-noted problems by providing a chewable sheath, also referenced herein as a chewable device, attachable to a writing instrument and comprising a shell with one or a plurality of layers of resilient material of various relative degrees of hardness, the shell can have an open end and a closed end. The chewable sheath can be placed on either the writing end or the non-writing end of a writing instrument. Further disclosed is a chewable sheath containing a writing means comprising a shell with one or a plurality of layers of resilient material having a writing end and a chewing end, and a writing means disposed within said resilient material and extending outwardly from the writing end.

It is an object of the present invention to prevent damage to writing instruments from the chewing activity of individuals who chew on writing instruments and writing instrument attachments. It is further object of the present invention to prevent damage to the teeth, gums, tongue, lips, and oral cavity of individuals who chew on writing instruments and writing instrument attachments. It is also an object of the present invention to prevent damage to, or toxic poisoning to, the oral cavity, gums, tongue, or internal organs of individuals who chew on writing instruments and writing instrument attachments. It is an object of the present invention to prevent ink stains on the skin on the face, hands, or on clothing or articles of property as a result of chewing on writing instruments and writing instrument attachments. It is an object of the present invention to provide supplemental dental hygiene to individuals who chew on writing instruments and writing instrument attachments. It is a further object of the present invention to provide protection against unsightly and unattractive fraying or damage to the writing instrument or writing instrument attachment. It is also an object to provide tension relief to the chewer. It is an object to enhance the quality and aroma of the chewers' breath as perceived by third persons. It is an object to provide relief to reticent smokers and tobacco chewers. It is an object to facilitate the quitting of smoking. It is an object to facilitate the quitting of chewing tobacco. It is an object to facilitate the quitting of chewing on writing instruments and accessories.

The resilient material of the shell is durable, being resilient to wear over long periods of chewing action in a damp environment, protective of the covered writing instrument end, and suitable for insertion into the oral cavity and protracted chewing thereon. When more than one casing or shell is used in making a chewable sheath or combination, the inner most shell or shells may be made of harder material, such as relatively harder resilient material than the outer shell or shells, or other harder material such as metal, wood, or hard plastics.

The chewable sheath attachable to a writing instrument may be made through several mold and mold injection processes well known in the art. The chewable sheath containing a writing means may be made through several mode and mold injection processes known in the art in conjunction with well known process for making pens, pencils, markers, and other writing instruments.

The different layers of the shell can be flavored differently for variety, and the layers can be ablative provided the material is non-toxic to ingest. The different layers may be flavored with a suitable extract, aromatic and attractively flavored to the chewer; may be flavored with a suitable extract, bitter and unattractively flavored to the chewer; may be flavored with a suitable extract including nicotine or nicotine tasting substance, soothing and relieving to the reticent smoker and reticent chewing tobacco user; may be flavored with a suitable extract, aromatic and attractively smelling to third persons; may be flavored with a suitable extract including flouride or teeth or gum cleansing mouthwash. Flavoring of resilient material can be accomplished through several well-known processes such as, for example, those disclosed in patents for flavored chewable animal toy articles and methods of manufacture.

Resilient material which has been attractively flavored increases the oral satisfaction to the chewer. Resilient material which has been bitterly flavored increases habit breaking pressures on the chewer. Resilient material which has been nicotine flavored increases oral satisfaction to the smoking and former smoker and to the tobacco chewer, which in turn increases smoking and tobacco chewing habit breaking pressures on the chewer. Resilient material which has been flavored with aromatic essences decrease offensive breath odors. Resilient material which has been flavored with oral medicaments such as fluoride increases dental hygiene. Advantage is further obtained from the protection against unattractive fraying or damage to the writing instrument or writing instrument attachment. Advantage further stems from the tension relief properties that chewing or gnashing on a chewable writing accessory or combination provides.

A principal advantage of a chewable sheath is the protection afforded to the writing instrument and writing means which would otherwise be marred, destroyed, punctured, or exploded by the chewing action and damp conditions of the oral cavity. Advantage is also obtained in the protection from fraying, leaking, and nonfunction of the writing instrument and writing means from the chewing action. A further advantage stems from a reduction or elimination of damage to teeth, gums, tongue, or oral cavity of individuals who chew on writing instruments. Another advantage is the protection afforded to the skin, clothes, and personal articles of individuals who chew on writing instruments from leakage of the writing means out of the writing instrument chewed upon.

These and other objects, features, and advantages of the instant invention will be more fully understood after reading the following detailed description of the preferred embodiment with reference to the accompanying drawings and viewed in accordance with the appended claims.

DETAILED DESCRIPTION OF THE PREFERRED EMBODIMENTS

Figure 1:
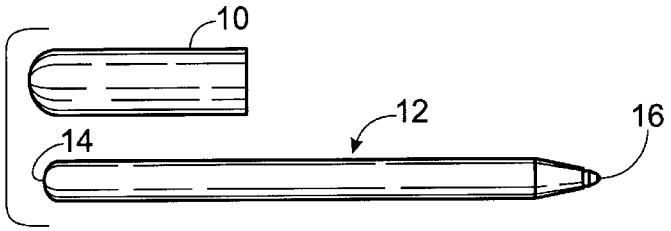
FIG. 1 illustrates a first aspect of the present invention along side an exemplary writing instrument.
Figure 2:
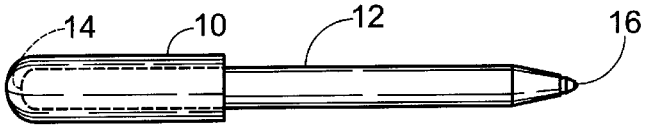
FIG. 2 is a side view of the embodiment in FIG. 1 of a chewable sheath wherein said chewable sheath is fitted onto a writing instrument so as to cover the non-writing end of the writing instrument.
Figure 3:
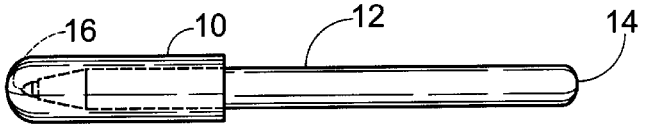
FIG. 3 is a side view of the embodiment in FIG. 1 of a chewable sheath wherein said chewable sheath is fitted onto a writing instrument so as to cover the writing end of the writing instrument.
Figure 4:
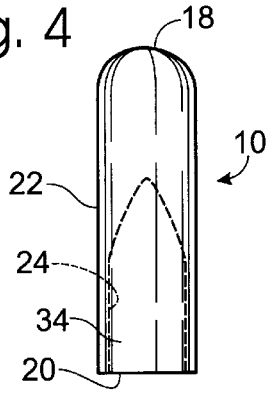
FIG. 4 is a side view of an embodiment of a chewable sheath with a single layered shell enclosing a hollow void, said shell having an outer surface, and an inner surface.
Figure 11:
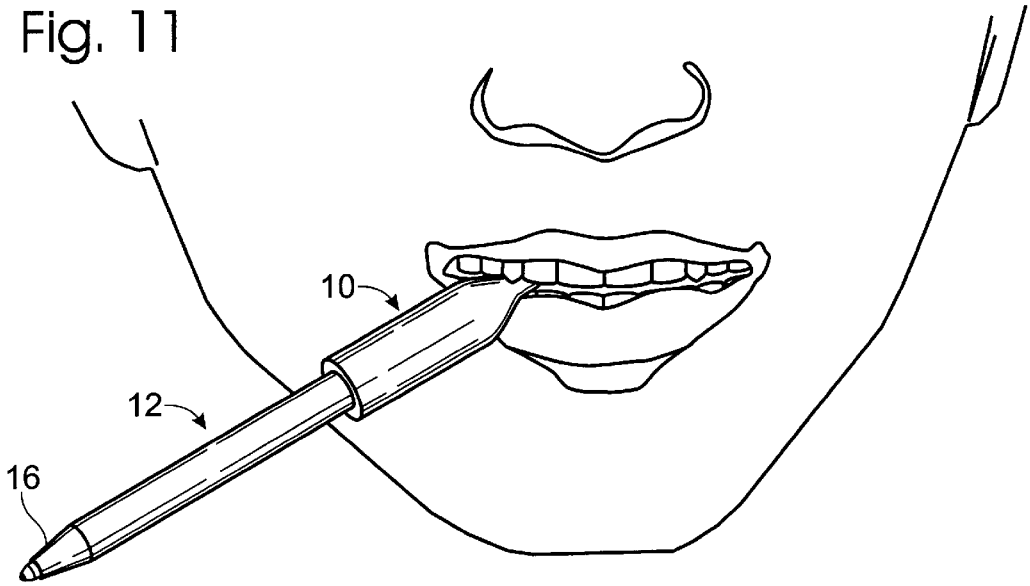
FIG. 11 shows a chewable sheath fitted onto a writing instrument as used in the oral cavity.
Figure 12:
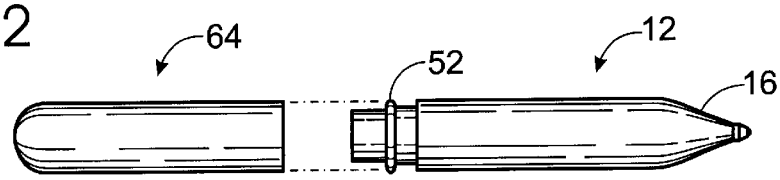
FIG. 12 is a side view of an embodiment of a chewable sheath and a writing instrument, showing a snap ridge on the writing instrument that the chewable sheath can be snap fit fitted along.
Figure 13:
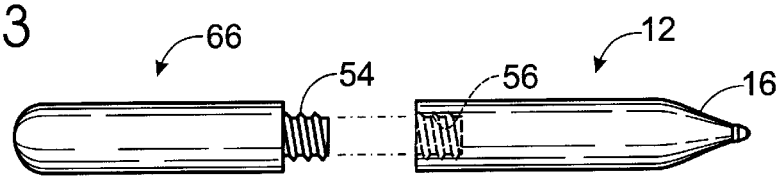
FIG. 13 is a side view of an embodiment of a chewable sheath attachable to a writing instrument showing a threads on the chewable sheath mateable to corresponding threads on a writing instrument.
Figure 14:
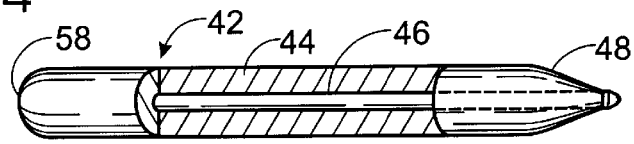
FIG. 14 is a partial cutaway side view of an embodiment of a chewable sheath containing a writing means showing a cylindrical body of resilient material with a chewable end, a writing end, and means for writing disposed within said cylindrical body and extending outwardly from the writing end.

According to FIGS. 1, 2, 3, 4, and 11, one embodiment of the chewable sheath (10) is a cylindrical shell with a closed end (18) and an open end (20) that is attachable through the open end (20) to either the writing end (16) or the non-writing end (14) of a writing instrument (12) by longitudinally fitting the chewable sheath (10) along the length of the writing instrument (12), through the open end (20) to cover the end of the writing instrument to which it is attached (FIGS. 2, 3, 11).

Writing instruments to which a chewable sheath may be fitted include pens, pencils, markers, and highlighters. The chewable sheath (10, 60, 62, 64, 66) can be made in differing sizes and shapes in relation to length, width, volume, and diameter to accommodate different sizes and shapes of writing instruments. The chewable sheath (10, 60, 62, 64, 66) can be made to facilitate gripping, gnawing, and chewing in the human oral cavity, as in FIG. 5.

The chewable sheath (10, 60, 62, 64, 66) can be attached on the writing instrument (12) by several means. Suitable means for attaching are well known in the technical field and are discussed, for example, in U.S. Pat. No. 5,248,232, U.S. Pat. No. 5,174,672, which are incorporated herein by reference. The chewable sheath can be friction fit on the writing instrument such that it slides longitudinally onto and along the length of the writing instrument (12) through the open end (20) of the chewable sheath (10) and remains in place through the force of friction. The chewable sheath (66) can screwed onto the writing instrument by means of a threads (54) on the chewable sheath (66) and corresponding threads (56) on the writing instrument (12). The chewable sheath may have a threaded collar integral to and extending from the inner shell open end engageable with equal screw pitch to an internal thread, on the writing instrument. Alternatively, the writing instrument may have a threaded shaft or collar attached or integral to the writing instrument engageable with equal screw pitch to an internal thread on the inside of and extending inwardly from the open end of the chewable sheath inner shell. The chewable sheath (64) can be snapped onto the writing instrument by means of a snap ridge on the writing instrument (52).

The chewable sheath (10) may be made of a shell with at least one layer composed of resilient material. The chewable sheath (60, 62) may also be composed of a multilayered shell having a harder inner layer (28, 40) and a plurality of outer layers (26). Constructions of this type are well known in the technical field and are discussed, for example, in U.S. Pat. No. 3,924,638, U.S. Pat. No. 4,432,114, U.S. Pat. No. 4,425,911, U.S. Pat. No. 5,766,223, U.S. Pat. No. Re. 34,352, which are incorporated herein by reference.

The outer layers (26) can be composed of resilient material. The resilient material is durable, being resilient to wear over long periods of chewing in a damp environment, easily sanitized, protective of the covered writing instrument end, and suitable for insertion into the oral cavity and chewing thereon. Suitable resilient materials include materials having a durometer or hardness between 30 to 90 such as polyurethane, rubber compounds, resins, and polyethylene having a hardness of between 30 and 90. Resilient materials can also be composed of plastic, such as an acrylic, having properties of flexibility and elasticity. Suitable materials are well known in the technical field and are discussed, for example, in U.S. Pat. No. 5,766,223, U.S. Pat. No. 5,653,731, U.S. Pat. No. 4,585,416, U.S. Pat. No. 4,513,014, U.S. Pat. No. 3,924,638, U.S. Pat. No. 4,765,324, U.S. Pat. No. 4,425,911, U.S. Pat. No. 4,519,386, U.S. Pat. No. 4,204,324, U.S. Pat. No. 4,432,114, U.S. Pat. No. 4,149,815, U.S. Reissue Pat. No. 34,352, and U.S. Pat. No. 3,924,638, to name a few, which are herein incorporated by reference.

The inner layer (28, 40) is comprised of the same or relatively harder material than the outer layers (26) such as polypropylene of polycarbonate or plastic and polyurethane, rubber compounds, resins, and polyethylene having a hardness of between 30 and 90. The inner layer (28, 40) may also be composed of wood, metals, or other material protective of the writing instrument (12) to which a chewable sheath is attached.

Figure 5:
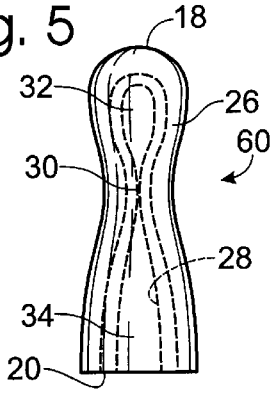
FIG. 5 illustrates a second aspect of the present invention, and shows a side view of a chewable sheath with a multi-layered shell containing an enclosed pocket for grip advantage.
Figure 6:
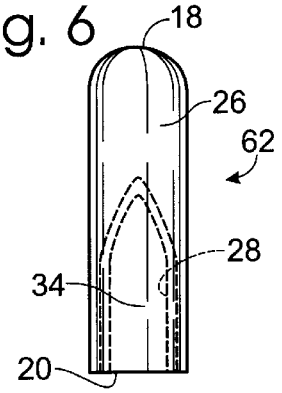
FIG. 6 illustrates a third aspect of the present invention, and shows a side view of a chewable sheath with a multi-layered shell.
Figure 7:
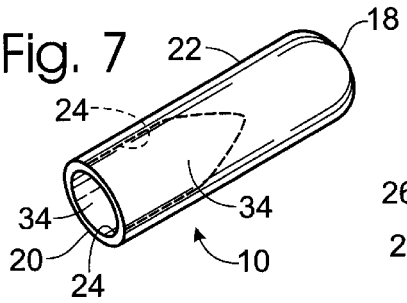
FIG. 7 is a perspective view of an embodiment of a chewable sheath. The figure shows the open end of the chewable sheath coming out of the drawing, and the closed end of the chewable sheath going into the drawing.
Figure 8:
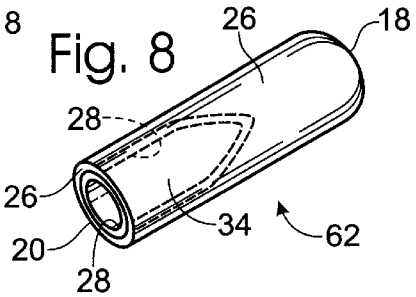
FIG. 8 is a perspective view of an embodiment of a chewable sheath showing an a multi-layered shell. The figure shows the open end of the chewable sheath coming out of the drawing, and the closed end of the chewable sheath going into the drawing.
Figure 9:
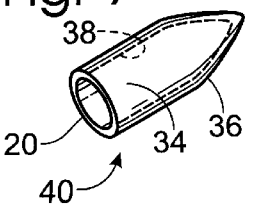
FIG. 9 is a perspective view of the inner layers of the chewable sheath shown in FIG. 8. The figure shows the open-end of the chewable sheath coming out of the drawing.
Figure 10:
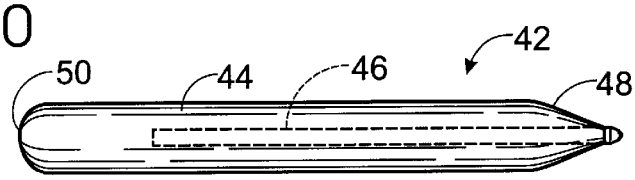
FIG. 10 illustrates yet another aspect of the present invention, and shows a side view of a chewable sheath containing a writing means.

The inner layer (28, 40) can be made to provide, in addition to protection to the writing instrument, a suitable bit or teeth grip when inserted in the oral cavity (FIG. 5). The single layer shell (FIG. 4) or inner layer of a multiple layer shell (28, 40) can also be formed to deflect and/or minimize the force of the chewing action on the protected writing instrument. One embodiment of a chewable device (FIGS. 4, 7) shows an outer surface (22) of the shell and an inner surface (24) of the shell encasing a hollow void (34), with the inner surface conical shaped (24) to deflect and/or minimize the force of the chewing action on the protected writing instrument. Another embodiment (FIG. 5) shows a multi-layer shell having an inner shell (28) with a hollow elongated conical portion (34), a grippable portion (32) adapted to being gripped by the teeth, gums, and lips of the chewer, and a connecting portion (30) connecting the elongated conical portion (34) and the grippable portion (32). The grippable portion (32) can be a hollow shell or a solid. The inner shell (28) can be two separate parts with no connection between the grippable portion and the elongated conical portion.

Another embodiment is composed of a cylindrical body (42), having a writing end (48) and a non-writing end (50), with the cylindrical body composed of a shell of one or more layers of resilient material (44) having varying degrees of relative hardness, and a writing means 46 disposed within and encased by such cylindrical body (42) and extending outwardly from the writing end (48). When the shell is composed of a plurality of layers, the innermost layer or layers may be made of non-resilient material, such as metal, wood, fiber, or other writing means-containing material as shown and disclosed in the art. The writing means can be means for writing in ink, lead for writing in pencil, or other known writing means. One example of a chewable sheath containing a writing means is a casing of resilient material formed around a lead based wood pencil. This allows the pencil to be chewed without lead poisoning, teeth chipping, or damage to the writing instrument.

The outermost surface of the chewable device may be covered by a plurality of raised nodules, depressions or dimples, and/or bristles, and may have an uneven surface. Nodules, depressions, dimples, and/or bristles provide a supplement to dental hygiene, creating a brushing, massaging, and particle loosening action in use. Suitable methods for creating these raised nodules, depressions or dimples, and/or bristles, and uneven surface are well known in the technical field and are discussed, for example, in U.S. Pat. No. 5,766,223, U.S. Pat. No. 4,585,416, and U.S. Pat. No. 4,432,114, which are incorporated herein by reference.

The chewable device may be made through several known mold and mold injection processes. Suitable mold and mold injection processes are well known in the technical field and are discussed, for example, in U.S. Pat. No. 4,425,911, U.S. Reissue Pat. No. 34,352, U.S. Pat. No. 5,653,731, U.S. Pat. No. 4,765,324, and U.S. Pat. No. 4,432,114, which are incorporated herein by reference. When the chewable device is composed of a shell with a plurality of layers, the layers are integral and may be bonded using friction fit, welding, molecular bonding, non-toxic adhesive or glue, and other known processes for encasing resilient material over relatively harder material. Suitable methods for encasing are well known in the technical field and are discussed, for example, in U.S. Pat. No. 5,653,731, which is incorporated herein by reference.

The chewable device may be flavored with a suitable extract attractively aromatic and tasteable by the chewer. The chewable device may be flavored with a suitable extract for a bitter taste to the chewer. The chewable device may be flavored with oral medicaments, such as fluoride. The chewable device may be flavored with aromatic essences. The chewable device may be nicotine or nicotine substitute flavored with a suitable extract. Flavoring of resilient material can be accomplished through several known processes such as that disclosed in U.S. Pat. No. 4,513,014, U.S. Pat. No. 4,432,114, U.S. Pat. No. 5,035,242, U.S. Pat. No. 4,513,014, U.S. Pat. No. 4,907,605, U.S. Pat. No. 3,603,319, and U.S. Pat. No. 4,736,755, which are herein incorporated by reference, or according to other methods of flavoring resilient material, of which several are known.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

I claim:

1. A chewable device, comprising a shell with one or more layers, having an open end and a closed end, made of resilient material suitable for placing in the human oral cavity and being chewed upon by human teeth within the human oral cavity without damaging the device or the oral cavity wherein the resilient material is composed of polyurethane, rubber compounds, resins, polyethylene, or plastic and wherein the shell is adapted to being fitted onto either end of a writing instrument and protects the writing instrument when inserted into the oral cavity and being chewed thereon.

2. A chewable device, comprising a shell with a plurality of layers, having an open end and a closed end, made of resilient material suitable for placing in the human oral cavity and being chewed upon by human teeth within the human oral cavity without damaging the device or the oral cavity wherein the resilient material is composed of polyurethane, rubber compounds, resins, polyethylene, or plastic and wherein the shell is adapted to being fitted onto either end of a writing instrument.

3. A chewable device as in claim 1 or 2, wherein the chewable device is adapted to be fitted onto a writing instrument by means selected from the group consisting of:

a. threads on the chewable device and the writing instrument such that the chewable device can be screwed onto the writing instrument;

b. friction fit such that the chewable device can be friction fitted onto a writing instrument; and c. a snap ridge on the chewable device or writing instrument such that a chewable device can be snap fitted onto the writing instrument.

4. A chewable device, comprising:

a. writing means; and b. a shell with one or a plurality of layers, the outermost layer being made of resilient material suitable for placing in the human oral cavity and being chewed upon by human teeth within the human oral cavity without damaging the device or the oral cavity wherein the resilient material is composed of polyurethane, rubber compounds, resins, polyethylene, or plastic and, said shell encasing and protecting said writing means and allowing said writing means to extend from said shell for purposes of writing.

5. A chewable device as in claims 1, 2, or 4, wherein the device is flavored.

6. A device as in claims 1, 2, or 4, wherein the device is treated with flouride.

7. A device as in claims 1, 2, or 4, wherein the device is flavored from the flavor group consisting of nicotine, nicotine tasting substance, cherry flavor extract, vanilla flavor extract, and orange flavor extract, bitter tasting substance, and aromatic substance.

8. A device as in claims 1, 2, or 4, wherein when more than one layer is provided the innermost layer is made of a harder substance chosen from the group consisting of wood, metal, and hard plastic.

* * * * *